US006872062B2

(12) United States Patent
Morozumi

(10) Patent No.: US 6,872,062 B2
(45) Date of Patent: Mar. 29, 2005

(54) SCROLL COMPRESSOR

(75) Inventor: Naoya Morozumi, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 10/757,992

(22) Filed: Jan. 16, 2004

(65) Prior Publication Data

US 2004/0146420 A1 Jul. 29, 2004

(30) Foreign Application Priority Data

Jan. 21, 2003 (JP) ..... 2003-011834

(51) Int. Cl.[7] ..... F04C 18/00

(52) U.S. Cl. ..... 418/55.1; 418/55.6; 418/94; 418/150; 184/6.18

(58) Field of Search ..... 418/55.1, 55.5, 418/55.6, 57, 150, 94; 184/6.18

(56) References Cited

U.S. PATENT DOCUMENTS 5,304,045 A * 4/1994 Hoshino et al. ..... 418/55.6

FOREIGN PATENT DOCUMENTS

| | | | | |
|---|---|---|---|---|
| JP | 59113290 A | * | 6/1984 | ..... F04C/29/02 |
| JP | 01178988 A | * | 7/1989 | ..... G03G/15/08 |
| JP | 04054296 A | * | 2/1992 | ..... F04C/18/02 |
| JP | 04365983 A | * | 12/1992 | ..... F04C/18/02 |
| JP | 2572215 | | 10/1996 | |

* cited by examiner

*Primary Examiner*—Thomas Denion
*Assistant Examiner*—Theresa Trieu
(74) *Attorney, Agent, or Firm*—Manabu Kanesaka

(57) ABSTRACT

To provide a scroll compressor that has a lower sliding friction loss and high compression efficiency, taking the diameter of a main shaft (61) as Dm and the diameter of a crank shaft (62) as Dc, the crank shaft (62) formed at one end of the main shaft (61) is arranged so that the eccentricity e thereof with respect to the main shaft (61) has a relation of e>(Dm−Dc)/2. Further, to support a main bearing (31) of a main frame (3) by the main shaft (61) serving as a sliding bearing and to support a crank bearing (421) of an orbiting scroll (42) by the crank shaft (62) serving as a sliding bearing, a joint shaft (65) for connecting the main shaft (61) and the crank shaft (62) to each other is formed so as to have a shape that falls within the main shaft diameter and within the crank shaft diameter when viewed in the axial direction.

2 Claims, 5 Drawing Sheets

SCROLL COMPRESSOR

TECHNICAL FIELD

The present invention relates to a scroll compressor used to compress a refrigerant etc. for, for example, an air conditioner. More particularly, it relates to improvement in a rotational drive shaft, which can achieve high compression efficiency and a low cost.

BACKGROUND ART

First, a general construction of a scroll compressor 1A of a closed vertical type in which a refrigerant compressing section is arranged above an electric motor will be described with reference to FIG. 4. For this scroll compressor 1A, the interior of a closed shell 2 is divided into a compression chamber CC having a refrigerant compressing section 4 and an electric motor chamber MC having an electric motor 5 by a main frame 3.

A rotational driving force generated by the electric motor 5 is transmitted to the refrigerant compressing section 4 via a rotational drive shaft 6, and revolves an orbiting scroll 42, which is fixed to the tip end of the rotating drive shaft 6, with respect to a fixed scroll 41, by which a refrigerant is compressed.

Usually, the rotational drive shaft 6 includes a main shaft 61 disposed coaxially in the electric motor chamber MC, a crank shaft 62 fixed integrally to one end (upper end in FIG. 4) of the main shaft 61, and a subsidiary shaft 66 fixed integrally to the other end of the main shaft 61.

The crank shaft 62 is arranged so as to be eccentric by a predetermined distance with respect to the main shaft 61 to revolve the orbiting scroll 42 of the refrigerant compressing section 4. The subsidiary shaft 66 is fixed coaxially with the main shaft 61.

The main shaft 61 is supported by a main bearing 31 of the main frame 3, and the subsidiary shaft 66 at the other end (lower end of FIG. 4) of the main shaft 61 is supported by a subsidiary bearing 71 of a sub-frame 7.

In the scroll compressor, the crank shaft 62 is broadly divided into two types as described below. Firstly, a first type (hereinafter referred to as type 1) is a type in which as shown in FIG. 4, the crank shaft diameter Dc is smaller than the main shaft diameter Dm, and the crank shaft 62 is arranged within the outside diameter of the main shaft 61 when viewed in the axial direction. Specifically, in type 1, the eccentricity e of the crank shaft 62 has a relation of $e \leqq (Dm-Dc)/2$.

According to type 1, when the compressor is assembled, the rotational drive shaft 6 can be inserted from either the compression chamber CC side or the electric motor chamber MC side with respect to the main bearing 31 of the main frame 3. However, this rotational drive shaft 6 has no portion for supporting its weight. Therefore, usually, after the refrigerant compressing section 4 consisting of the fixed scroll 41 and the orbiting scroll 42 has been assembled to the main frame 3, the rotational drive shaft 6 is inserted into the orbiting scroll 42 from the electric motor chamber MC side.

Secondly, a second type is a type in which for example, as shown in FIG. 5, the main shaft diameter Dm is approximately equal to the crank shaft diameter Dc, and the crank shaft 62 is shifted by eccentricity e from the main shaft 61. Specifically, in the second type, the eccentricity e has a relation of $e>(Dm-Dc)/2$. This second type is further classified into two subclasses.

First, a first subclass (hereinafter referred to as type 2-1) is a type in which, for example, as described in Japanese Patent No. 2572215, a main bearing of a main frame is formed of a roller bearing, and a hook-shaped "relief" is provided between the crank shaft and the main shaft, and this "relief" is slid in a radial direction in a main shaft receiving portion so that the crank shaft can be inserted from the electric motor chamber MC side. According to this type, without decreasing the crank shaft diameter, the crank shaft can be inserted from the electric motor chamber MC side as in the above-described type 1.

Next, a scroll compressor 1B of a second subclass (hereinafter referred to as type 2-2) is of a type in which as shown in FIG. 5, a flange portion 63 that has a larger diameter than the main shaft 61 and is coaxial with the main shaft 61 is provided between the main shaft 61 and the crank shaft 62 to support the weight of the rotational drive shaft 6. In this case, it is necessary to insert the rotational drive shaft 6 into the main frame 3 before the refrigerant compressing section 4 is assembled to the main frame 3. After the refrigerant compressing section 4 has been assembled, the rotational drive shaft 6 does not come off from the main frame 3 even if the compressor is moved vertically during the assembly of the whole of the compressor.

However, the above-described scroll compressors 1A and 1B have problems as described below. In type 1, in order to give revolving motion necessary for compression of refrigerant to the orbiting scroll 42, it is necessary to make design so that the crank shaft diameter Dc is about 30% smaller than the main shaft diameter Dm. The small diameter of the crank shaft 62 inevitably decreases the load-carrying strength, so that there is a fear of decreased reliability in terms of strength.

When an attempt is made to increase the crank shaft diameter Dc to enhance the reliability, the main shaft diameter Dm must be increased relatively greater than necessary for the load-carrying strength. Accordingly, there arises a problem of increased sliding friction loss of main shaft.

Referring to FIG. 4, when a load applied to a bearing portion 421 of the crank shaft 62 against compressed gas is taken as Fc, the axial distance from the crank shaft 62 to the main bearing 31 of the main frame 3 is taken as Lm, and the axial distance from the crank shaft 62 to the subsidiary bearing 71 is taken as Ls, the load Fm applied to the main shaft 31 is expressed as $$Fm=Fc\times(Ls/(Ls-Lm))$$

From this formula, it can be seen that as Lm decreases, the load Fm applied to the main bearing 31 decreases.

Contrarily, in type 2-1, the axial distance between the main bearing 31 and the crank bearing 421 is inevitably long, so that the load applied to the main bearing 31 increases. Therefore, it is difficult to support the main bearing 31 by a sliding bearing, and thus the main bearing 31 must be changed to a roller bearing. However, the roller bearing is more expensive than the sliding bearing.

In type 2-2, the axial distance Lm can be shortened as compared with type 2-1. However, since the flange portion 63 is provided between the main shaft 61 and the crank shaft 62, the axial distance between the main bearing 31 and the crank bearing 421 inevitably increases by the thickness (axial length) of the flange portion 63. Therefore, the load applied to the main bearing 31 is still high, which presents a problem in that the sliding friction loss increases resultantly.

SUMMARY OF THE INVENTION

The present invention has been made to solve the above-described problems, and accordingly an object thereof is to provide a scroll compressor that has a lower sliding friction loss and high compression efficiency.

To achieve the above object, the present invention provides a scroll compressor in which the interior of a closed shell is divided into a compression chamber and an electric motor chamber by a main frame; and a rotational drive shaft is provided to transmit a rotational driving force generated in the electric motor chamber into the compression chamber, wherein the rotating drive shaft has a main shaft arranged coaxially in the electric motor chamber and a crank shaft, which is integrally formed at one end of the main shaft, for revolving an orbiting scroll in the compression chamber; taking the diameter of the main shaft as Dm and the diameter of the crank shaft as Dc, the crank shaft is arranged so that the eccentricity e thereof with respect to the main shaft has a relation of $e>(Dm-Dc)/2$; between the main shaft and the crank shaft is provided a joint shaft having a length corresponding to a machining relief at the time when machining is performed with an accuracy necessary for functioning such that the main shaft serves as a sliding bearing with respect to a main bearing of the main frame and the crank shaft serves as a sliding bearing with respect to a crank bearing of the orbiting scroll; and the joint shaft has a shape which falls within the diameter Dm of the main shaft and within the diameter Dc of the crank shaft when viewed in the axial direction.

According to this configuration, the sliding friction loss of the main shaft can be kept at the minimum without impairing the reliability of the crank shaft, and hence a highly efficient scroll compressor can be obtained. In the present invention, the length of the joint shaft is preferably within 3 mm.

Also, as a preferred mode of the present invention, in the closed shell, there is provided a sub-frame having a subsidiary bearing for radially supporting a subsidiary shaft provided on the other end of the rotational drive shaft, and a thrust plate is fixed to the sub-frame via a retaining ring. According to this configuration, the weight of the rotational drive shaft is supported by the thrust plate, so that the support in the axial direction can be obtained without the provision of a flange portion 63 as shown in FIG. 5.

DETAILED DESCRIPTION

Figure 1:
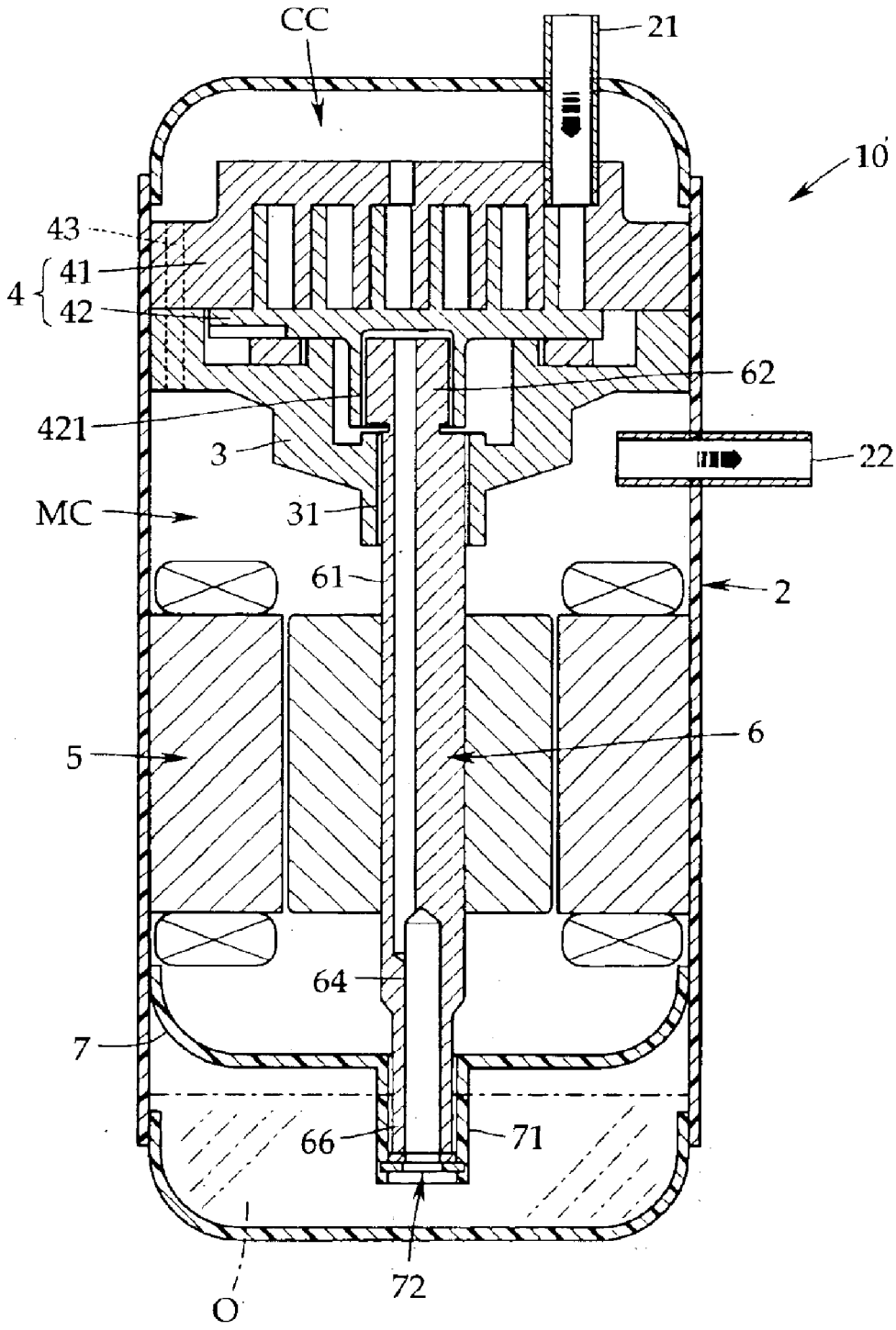
FIG. 1 is a schematic sectional view of a scroll compressor in accordance with one embodiment of the present invention.
Figure 4:
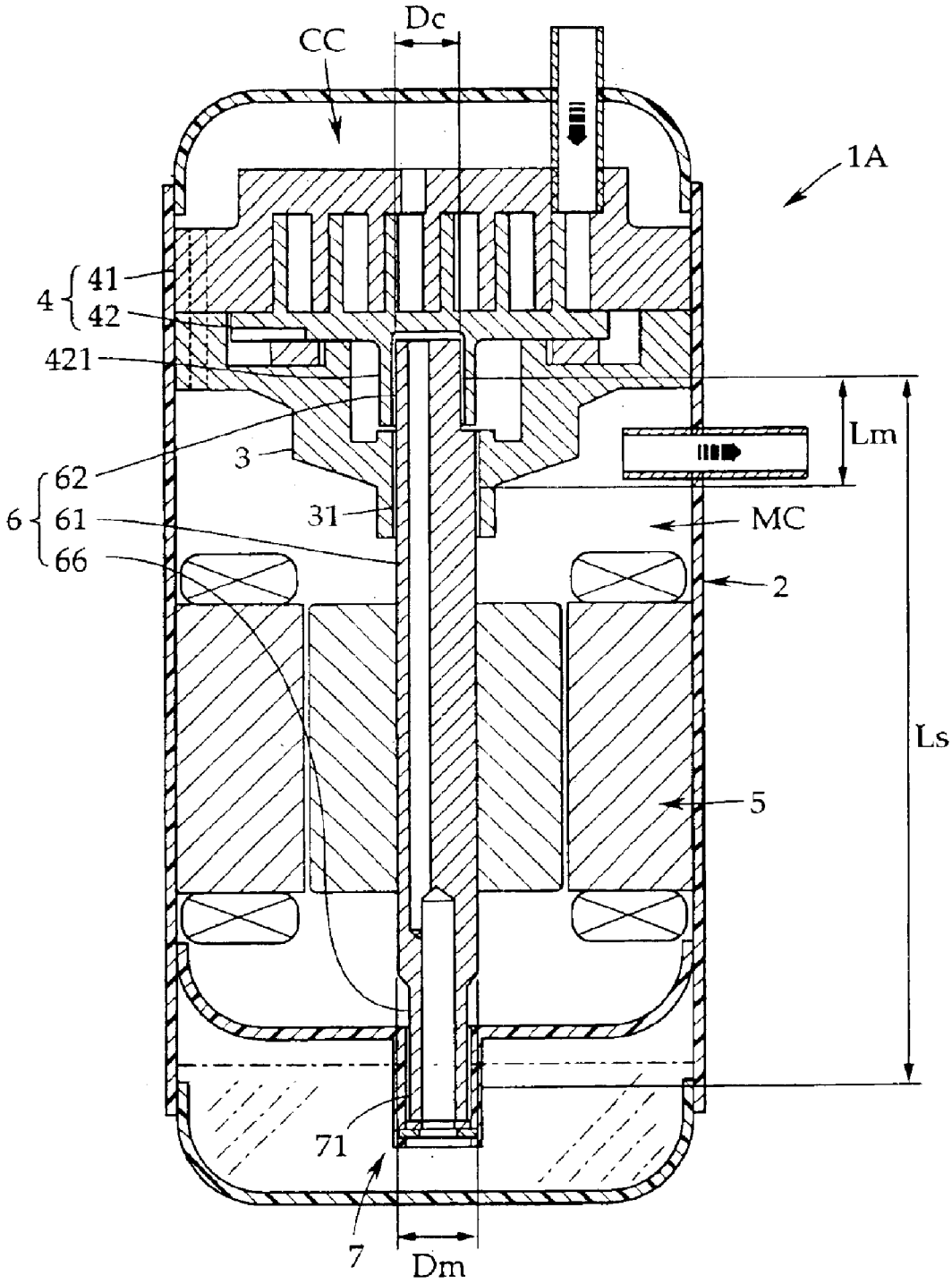
FIG. 4 Prior Art
FIG. 4 is a sectional view of a conventional scroll compressor.

An embodiment of the present invention will now be described with reference to the accompanying drawings. FIG. 1 is a schematic sectional view of a scroll compressor in accordance with one embodiment of the present invention. FIG. 2 is an enlarged sectional view of essential portions of a rotational drive shaft. In these figures, the same reference numerals are applied to elements that are regarded as the same as or equivalent to the elements of the beforementioned conventional example shown in FIG. 4.

This scroll compressor 10 has a cylindrical closed shell 2. The closed shell 2 is arranged vertically, and the interior thereof is divided into a compression chamber CC on the upper side and an electric motor chamber MC on the lower side by a main frame 3. In the compressor chamber CC, a refrigerant compressing section 4 consisting of a fixed scroll 41 and an orbiting scroll 42 is housed. In the electric motor chamber MC, an electric motor 5 for driving the refrigerant compressing section 4 and a rotational drive shaft 6 serving as an output shaft are housed.

In this example, the scroll compressor 10 is of an internal high pressure type, and at an upper part of the closed shell 2 is provided a refrigerant suction pipe 21 for drawing a low-pressure refrigerant that has finished work in a refrigerating cycle, not shown, into the refrigerant compressing section 4. At the side of the closed shell 2 is provided a refrigerant delivery pipe 22 for delivering a high-pressure refrigerant that has been compressed by the refrigerant compressing section 4 from the electric motor chamber MC to the refrigerating cycle. Also, in the bottom portion of the closed shell 2 is stored a fixed amount of lubricating oil O.

In the present invention, the constructions of the closed shell 2, the main frame 3, the refrigerant compressing section 4, and the electric motor 5 have only to have elements necessary for providing a scroll compression mechanism, and therefore they may be the same as the conventional ones. Therefore, the explanation thereof is omitted.

The rotational drive shaft 6 includes a main shaft 61 arranged coaxially with the electric motor 5 and a crank shaft 62 integrally formed at the upper end of the main shaft 61. The crank shaft 62 is arranged eccentrically with respect to the main shaft 61.

In the rotational drive shaft 6, a lubricating oil supply hole 64 is formed to supply the lubricating oil O stored in the bottom portion of the closed shell 2 to the refrigerant compressing section 4. The lubricating oil supply hole 64 is formed eccentrically with respect to the rotation axis of the main shaft 61. According to this configuration, the lubricating oil O is sucked up through the lubricating oil supply hole 64 by the rotation of the rotational drive shaft 6, and is supplied to the back surface of the orbiting scroll 42.

Figure 2A:
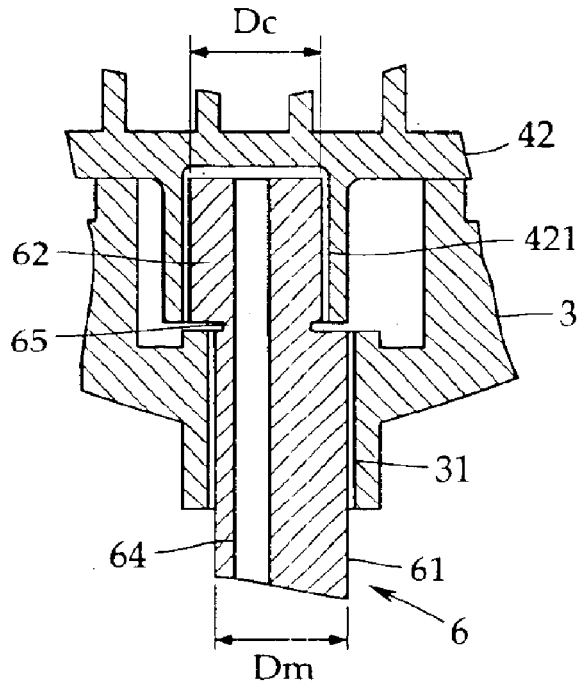
FIG. 2A is an expanded view of an upper end portion of a rotational drive shaft of the scroll compressor shown in FIG. 1.
Figure 2B:
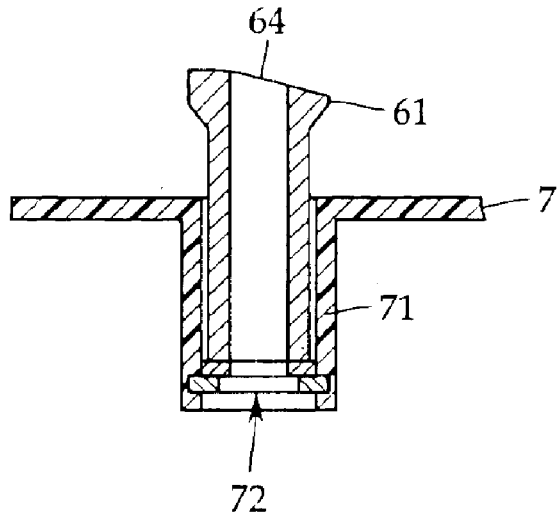
FIG. 2B is an expanded view of a lower end portion of the scroll compressor.

As shown in FIGS. 2A and 2B, the upper end of the main shaft 61 is supported in the radial direction by a main bearing 31 of the main frame 3, and the lower end thereof is supported in the radial direction by a subsidiary bearing 71 fixed to a sub-frame 7.

The lower end of the main shaft 61 is supported in the thrust direction by a thrust plate 72 fixed to the sub-frame 7 via a retaining ring. The weight of the rotational drive shaft 6 is supported by the thrust plate 72.

On the back surface side (lower surface side in FIG. 1) of the orbiting scroll 42, a crank bearing 421 for the crank shaft 62 is formed. The crank shaft 62 is connected to the crank bearing 421, whereby the orbiting scroll 42 revolves via the crank shaft 62.

Figure 3A:
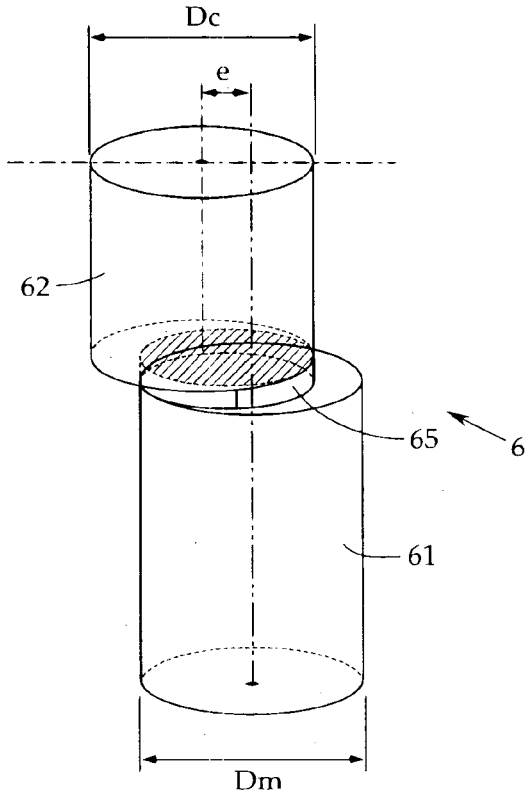
FIG. 3A is a schematic view for illustrating the relationship between a main shaft and a crank shaft.

As shown in FIG. 3A, when the diameter of the main shaft 61 is taken as Dm and the diameter of the crank shaft 62 is taken as Dc, the crank shaft 62 is arranged so that the eccentricity e thereof with respect to the main shaft 61 has a relation of $e>(Dm-Dc)/2$. This means that a part of the crank shaft 62 protrudes from the outside diameter of the main shaft 61 to the outside. In this example, the diameters of the main shaft 61 and the crank shaft 62 are almost the same.

Figure 3B:
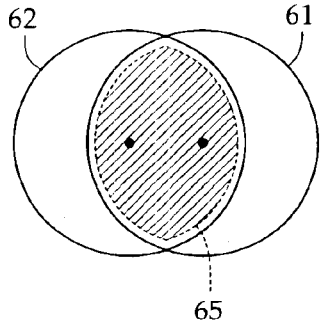
FIG. 3B is a plan view of the main shaft and the crank shaft viewed in an axial direction.

Between the main shaft 61 and the crank shaft 62, a joint shaft 65 is connected integrally. The joint shaft 65 is formed so as to fall within a range in which the main shaft 61 and the crank shaft 62 overlap with each other (hatched portion in FIG. 3A and FIG. 3B). As shown in FIG. 2A, the joint shaft 65 has a length corresponding to a machining relief at the time when machining is performed with an accuracy necessary for functioning such that the main shaft 61 serves as a sliding bearing with respect to the main bearing 31 of the main frame 3 and the crank shaft 62 serves as a sliding bearing with respect to the crank bearing 421 of the orbiting scroll 42.

Figure 3C:
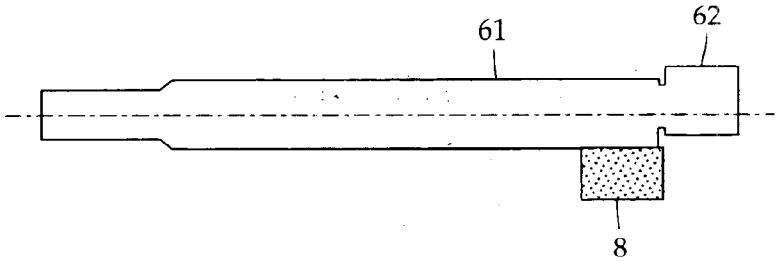
FIG. 3C is a schematic view for illustrating the machining relief.

The reason for this is as described below. As shown in FIG. 3C, the main shaft 61 and the crank shaft 62 are ground with a grindstone 8 as final finish to provide an accuracy necessary for the main shaft 61 and the crank shaft 62 to function as sliding bearings. If there is no predetermined gap between the main shaft 61 and the crank shaft 62, the whole of the portion serving as a sliding bearing cannot be ground with high accuracy.

In this embodiment, the axial length of the joint shaft 65 is 2 mm. However, the joint shaft 65 has only to have an axial length corresponding to the machining relief, preferably an axial length within 3 mm.

Figure 5:
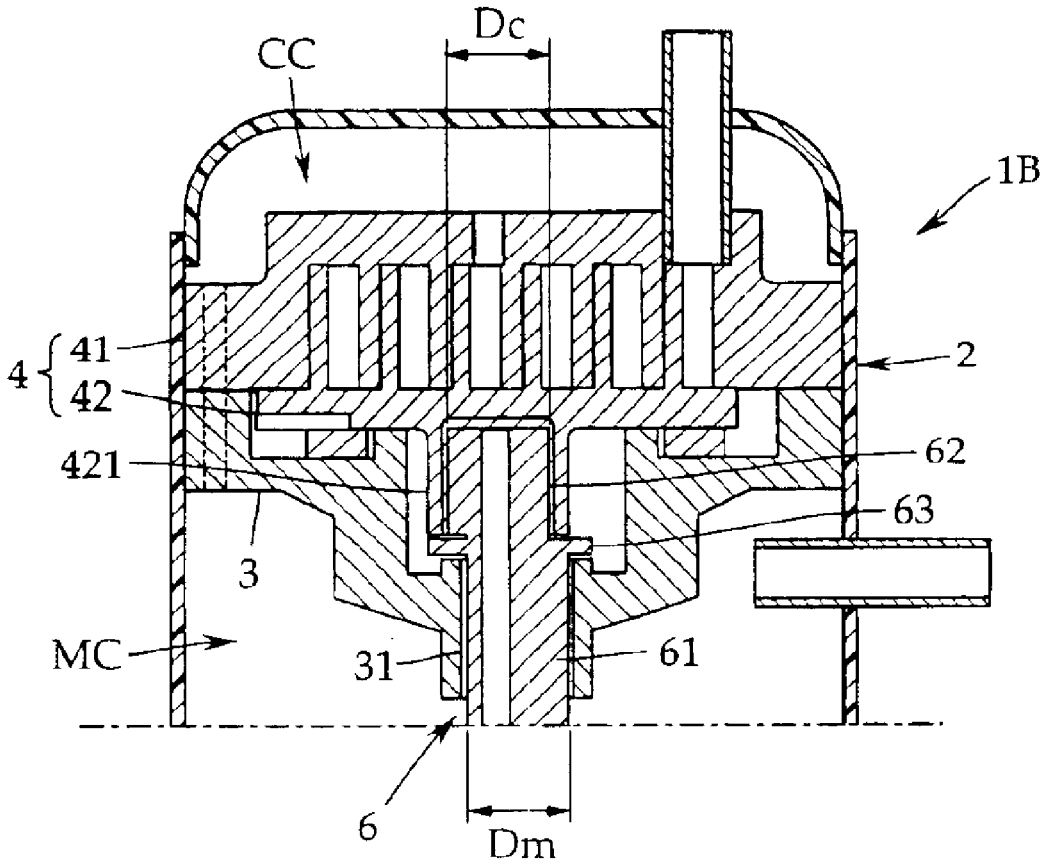
FIG. 5 Prior Art
FIG. 5 is a sectional view of an essential portion of a conventional scroll compressor.

According to this configuration, the main shaft 61 serves as a sliding bearing with respect to the main bearing 31 of the main frame 3 and the crank shaft 62 serves as a sliding bearing with respect to the crank bearing 421 of the orbiting scroll 42, so that the weight of the rotational drive shaft 6 can be supported without impairing the function as a bearing. Therefore, the axial distance further decreases as compared with the case where the conventional flange portion 63 (see FIG. 5) is provided, by which the load applied to the main bearing 31 can be decreased. Furthermore, the sliding friction loss of the main bearing 31 can be kept at the minimum without impairing the reliability of the crank bearing 421.

When this scroll compressor 10 is operated, a low-pressure refrigerant is introduced into the refrigerant compressing section 4 through the refrigerant suction pipe 21, being compressed in the refrigerant compressing section 4 as it flows toward the center, and is discharged into the compression chamber CC as a high-pressure refrigerant. The discharged high-pressure refrigerant is once drawn into the electric motor chamber MC through a passage 43 formed at a part of the fixed scroll 41 and the main frame 3, and is delivered from the electric motor chamber MC to the refrigerating cycle through the refrigerant delivery pipe 22.

At this time, the lubricating oil O is sent from the bottom portion of the closed shell 2 to the back surface of the orbiting scroll 42 through the lubricating oil supply hole 64 in the rotational drive shaft 6, and is supplied to bearing portions and sliding portions. After lubricating these portions, the lubricating oil O flows down in the electric motor chamber MC and returns again to the bottom portion of the closed shell 2.

In the above-described embodiment, the scroll compressor 10 has been explained by taking an internal high pressure type as an example. However, the present invention can be applied to a scroll compressor of a so-called internal low pressure type in which a low-pressure refrigerant is introduced into the closed shell 2 as a suction gas.

The above is a description of a preferred embodiment of the present invention given with reference to the accompanying drawings. However, the present invention is not limited to this embodiment. Various changes and modifications that can be thought of in the scope of technical idea described in claims by those skilled in the art who are engaged with a field of air conditioner and have usual technical knowledge should be naturally embraced in the technical scope of the present invention.

What is claimed is:

1. A scroll compressor in which an interior of a closed shell is divided into a compression chamber and an electric motor chamber by a main frame; and a rotational drive shaft is provided to transmit a rotational driving force generated in said electric motor chamber into said compression chamber, wherein said rotating drive shaft has a main shaft arranged coaxially in said electric motor chamber and a crank shaft, which is integrally formed at one end of said main shaft, for revolving an orbiting scroll in said compression chamber; taking the diameter of said main shaft as Dm and the diameter of said crank shaft as Dc, said crank shaft is arranged so that an eccentricity e thereof with respect to said main shaft has a relation of $e>(Dm-Dc)/2$;

between said main shaft and said crank shaft is provided a joint shaft having a length within 3 mm corresponding to a machining relief at a time when machining is performed with an accuracy necessary for functioning such that said main shaft serves as a sliding bearing with respect to a main bearing of said main frame and said crank shaft serves as a sliding bearing with respect to a crank bearing of said orbiting scroll; and said joint shaft has a shape which falls within the diameter Dm of said main shaft and within the diameter Dc of said crank shaft when viewed in the axial direction.

2. The scroll compressor according to claim 1, wherein a sub-frame for supporting an end of said rotational drive shaft is further provided in said closed shell, and the end of said rotational drive shaft is pivotally supported in a thrust direction via said sub-frame.

* * * * *